United States Patent [19]

Ohkubo

[11] Patent Number: 4,727,350

[45] Date of Patent: Feb. 23, 1988

[54] SURGE ABSORBER

[76] Inventor: Hitoshi Ohkubo, 362-28, Jyomyoji, Kamakula-shi, Kanagawa-ken, Japan

[21] Appl. No.: 17,347

[22] Filed: Feb. 20, 1987

[30] Foreign Application Priority Data

Apr. 28, 1986 [JP] Japan ..... 61-98655

[51] Int. Cl.[4] ..... H01C 7/10

[52] U.S. Cl. ..... 338/21; 338/300; 338/315; 338/272; 338/234

[58] Field of Search ..... 338/195, 21, 300, 308, 338/309, 234, 315, 272, 274, 275; 215/121 LH, 121 LJ; 361/39, 56, 91, 127

[56] References Cited

U.S. PATENT DOCUMENTS

| | | | |
|---|---|---|---|
| 1,595,737 | 3/1935 | Everett | 338/21 |
| 4,410,831 | 10/1983 | Shigemori et al. | 313/325 |
| 4,451,815 | 5/1984 | Sakshaug | 338/21 |
| 4,504,766 | 3/1985 | Kaneko | 313/634 |
| 4,542,365 | 9/1985 | McTavish et al. | 338/21 X |

FOREIGN PATENT DOCUMENTS

| | | | |
|---|---|---|---|
| 0046496 | 4/1977 | Japan | 338/21 |
| 0076341 | 7/1978 | Japan | 338/21 |
| 2168540 | 6/1986 | Japan | 338/21 |

*Primary Examiner*—C. L. Albritton

*Attorney, Agent, or Firm*—Wenderoth, Lind & Ponack

[57] ABSTRACT

A surge absorber in which an electrically conductive thin film is vaporized on the surface of a ceramic circular cylinder, a micro.groove is trimmed using a laser beam to define a spiral locus on the surface, and a linear.groove is trimmed to intersect the micro.groove to divide the thin film into a plurality of segments, so that overvoltages applied across the two electrodes can be absorbed.

6 Claims, 2 Drawing Figures

SURGE ABSORBER

BACKGROUND OF THE INVENTION

1. Field of the Invention

The present invention relates to a surge absorber in which an electrically conductive thin film is vaporized on the surface of a ceramic circular cylinder, a micro.-groove that defines a spiral locus is trimmed using a laser beam, and a linear.groove intersects the spiral locus to divide the thin film into a plurality of segments, such that an overvoltage applied across the electrodes is absorbed.

2. Description of the Related Art

Known surge absorbers having an electrically conductive thin film divided by a micro.groove into segments, are not capable of freely selecting the breakdown voltage (switching voltage), and thus has only limited applications.

SUMMARY OF THE INVENTION

The present invention is to provide a surge absorber that can be manufactured such that the switching voltage can be selected over a wide range. The invention will be described in detail in conjunction with the accompanying drawings.

BRIEF DESCRIPTION OF THE DRAWINGS

The drawings illustrate an embodiment of the present invention, wherein.

DETAILED DESCRIPTION OF THE PREFERRED EMBODIMENT

Figure 1:
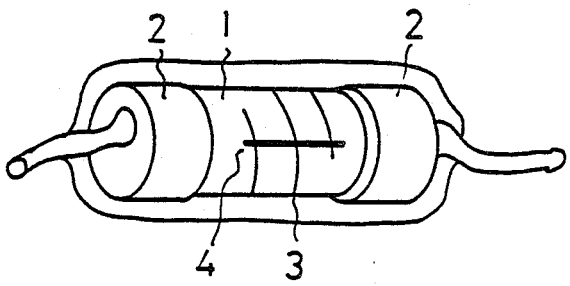
FIG. 1 is a perspective view of a surge absorber according to the present invention.

An electrically conductive thin film 1 comprised of a metal oxide such as tin oxide is vaporized on the surface of a ceramic circular cylinder, and metal caps 2, 2 that will serve as electrodes are fitted to both ends thereof. After the caps are brought into alignment, the cylinder is rotated at a predetermined speed. A source emitting a laser beam with which the thin film 1 is irradiated is moved at a predetermined speed along the axis of the circular cylinder, in order to trim a spiral micro.groove 3 having a width of about 50 μm in the thin film 1. Next, the rotation of the ceramic circular cylinder is stopped, and the source of laser light is moved along the axis of the circular cylinder, so that a linear.groove 4 having a width of at least 100 μm is trimmed and intersects the micro.groove 3 at three places.

Figure 2:
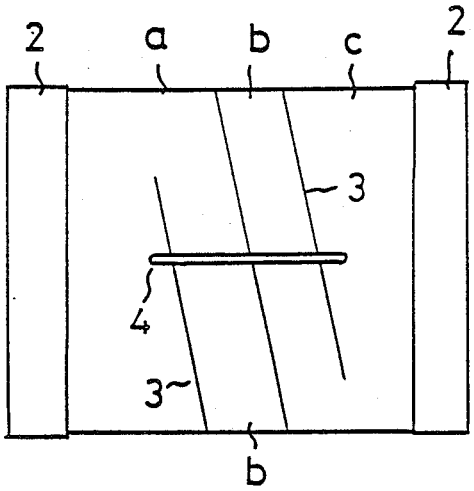
FIG. 2 is a diagram illustrating the advantages afforded by the present invention.

As will be understood from FIG. 2, the thin film 1 is divided into three regions (a), (b) and (c). The width of the linear.groove 4 should be greater to some extent than that of the micro.groove 3 in order to prevent discharge breakdown from taking place across the groove 4. The number of segments of the thin film 1 increases in proportion to the increase in the number of intersecting points of the linear.groove and micro.-groove. An inert gas such as argon under a pressure of about 0.5 atmosphere is confined by being sealed with a glass so as to comprise an ambient gas for the thin film 1.

The function of the device shown in FIGS. 1 and 2 will now be described. As an overvoltage is applied across the metal caps 2 and 2, aerial discharge breakdown takes place across the micro.groove 3 at intersecting portions where the electric charge tends to concentrate, giving rise to surge absorption or switching. The linear.groove 4 whose width is wide divides the regions (a), (b) and (c) into segments maintaining electric insulation, and prevents a short-circuit discharge from taking place across the regions (a) and (c) at the intersecting portion. The firing voltage is 480 volts in this embodiment in which there are three points of intersection between the micro.groove 3 and the linear.groove 4. When there are eight point of intersection, the firing voltage increases to 1500 volts. When there are only two points of intersection (when the thin film 1 is divided in two), the firing voltage is as low as 280 volts. There exists a constant relationship between the number of points of intersection and the firing voltage because the electric discharge takes place stably, the aerial discharge takes place at the points of intersection at all times and the discharge breakdown takes only across the micro.groove 3.

According to the present invention as described above, the micro.groove 3 is trimmed in a spiral manner in the electrically conductive thin film 1, and a linear.-groove 4 is trimmed in parallel to the axis to intersect the micro.groove 3, the linear.groove 4 having a width greater than that of the micro.groove 3 so that the electric discharge will not take place across the linear.-groove 4. Therefore, highly reliable segments can be easily formed compared with the conventional gap-forming surge absorber obtained by cutting in round slices. In the surge absorber according to the present invention, the aerial discharge takes place across the micro.groove 3 at the points of intersection and the discharge characteristics are stabilized.

What is claimed is:

1. A surge absorber comprising a ceramic cylinder on which a thin film is disposed, the thin film disposed on the cylinder having a micro groove extending therein in a spiral manner around the cylinder and a linear groove extending therein intersecting the micro groove, said linear groove having a width that is larger than the width of said micro groove.

2. A surge absorber according to claim 1, wherein the spiral micro.groove has a width of between 10 and 100 μm, and the linear.groove has a width that is greater than 100 μm.

3. A surge absorber according to claim 2, wherein the linear.groove extends parallel to the axis of the ceramic circular cylinder.

4. A surge absorber according to claim 1, wherein said film is a metal oxide.

5. A surge absorber according to claim 1, and further comprising respective electrodes on both ends of said cylinder, a seal around said cylinder and inert gas confined within said seal.

6. A surge absorber according to claim 5, wherein said seal is glass.

* * * * *

US004727350B1

REEXAMINATION CERTIFICATE (2210th)

United States Patent [19]

Ohkubo

[11] B1 4,727,350

[45] Certificate Issued Feb. 1, 1994

[54] SURGE ABSORBER

[76] Inventor: Hitoshi Ohkubo, 362-28, Jyomyoji, Kamakula-shi, Kanagawa-ken, Japan

Reexamination Request:
No. 90/003,068, May 25, 1993

Reexamination Certificate for:

| | |
|---|---|
| Patent No.: | **4,727,350** |
| Issued: | **Feb. 23, 1988** |
| Appl. No.: | **17,347** |
| Filed: | **Feb. 20, 1987** |

[30] Foreign Application Priority Data

Apr. 28, 1986 [JP] Japan ..... 61-98655

[51] Int. Cl.[5] ..... H01C 7/10

[52] U.S. Cl. ..... 338/21; 338/234; 338/272; 338/300; 338/315

[58] Field of Search ..... 338/21, 195, 272, 274, 338/275, 300, 308, 309, 315, 234; 219/121.68, 121.69; 361/39, 56, 91, 127

[56] References Cited

U.S. PATENT DOCUMENTS 4,317,155 2/1982 Harada et al. ..... 361/120

FOREIGN PATENT DOCUMENTS 58-7487 1/1983 Japan .

OTHER PUBLICATIONS

Proceeding of the Institute of Electrostatics, Japan, vol. 6, No. 6 (1982) 357-364.

*Primary Examiner*—Clarence L. Albritton

[57] ABSTRACT

A surge absorber in which an electrically conductive thin film is vaporized on the surface of a ceramic circular cylinder, a micro.groove is trimmed using a laser beam to define a spiral locus on the surface, and a linear.groove is trimmed to intersect the micro.groove to divide the thin film into a plurality of segments, so that overvoltages applied across the two electrodes can be absrobed.

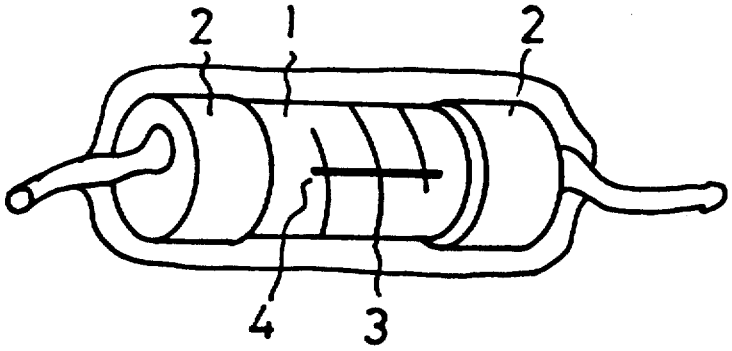

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–6 are confirmed.

* * * * *